US005488209A

United States Patent [19]

Orrico et al.

[11] Patent Number: 5,488,209

[45] Date of Patent: Jan. 30, 1996

[54] HINGE OPERATED SWITCH ASSEMBLY

[75] Inventors: Mario M. V. Orrico, Chicago; William J. Olson, Barrington; James S. Zielinski, Schaumburg; Randall M. Crippen, Chicago, all of Ill.

[73] Assignee: Illinois Tool Works Inc., Glenview, Ill.

[21] Appl. No.: 368,153

[22] Filed: Dec. 29, 1994

[51] Int. Cl.[6] ..... H01H 3/16

[52] U.S. Cl. ..... 200/61.7; 200/61.62

[58] Field of Search ..... 200/61.62, 61.69, 200/61.7–61.83, 302.1–302.3

[56] References Cited

U.S. PATENT DOCUMENTS

| | | | |
|---|---|---|---|
| Re. 30,716 | 8/1981 | Suska | 200/61.7 |
| 2,513,804 | 7/1950 | Kaminky | 74/97.2 |
| 4,049,934 | 9/1977 | Newlon | 200/61.7 |
| 4,150,265 | 4/1979 | Holden | 200/61.7 |
| 4,168,409 | 9/1979 | McNinch | 200/61.7 |
| 4,284,861 | 8/1981 | Senften | 200/61.7 |
| 4,721,946 | 1/1988 | Zunkel | 200/61.7 X |
| 4,922,064 | 5/1990 | Price et al. | 200/61.7 |

FOREIGN PATENT DOCUMENTS

| | | | |
|---|---|---|---|
| 304241 | 2/1989 | European Pat. Off. | 200/61.7 |
| 1279381 | 6/1972 | United Kingdom | 200/61.7 |
| 1333034 | 10/1973 | United Kingdom | 200/61.7 |

*Primary Examiner*—J. R. Scott
*Attorney, Agent, or Firm*—Schwartz & Weinrieb

[57] ABSTRACT

A switch assembly for activation by a shaft or hinge pin of a hinge includes a cam member connected for rotation along with the shaft and an actuating band operably connected to the cam member. The actuating band includes an engagement portion for contact with a first portion of a lever upon rotational movement of the shaft of the hinge and the cam member. The lever is movable to enable a second portion of the lever to contact an electrical switch to in turn make or break contact of a desired electrical circuit formed by the electrical switch. A sealing insert is included to provide a substantially waterproof seal between the hinge shaft and the switch assembly.

20 Claims, 5 Drawing Sheets

FIG. 5
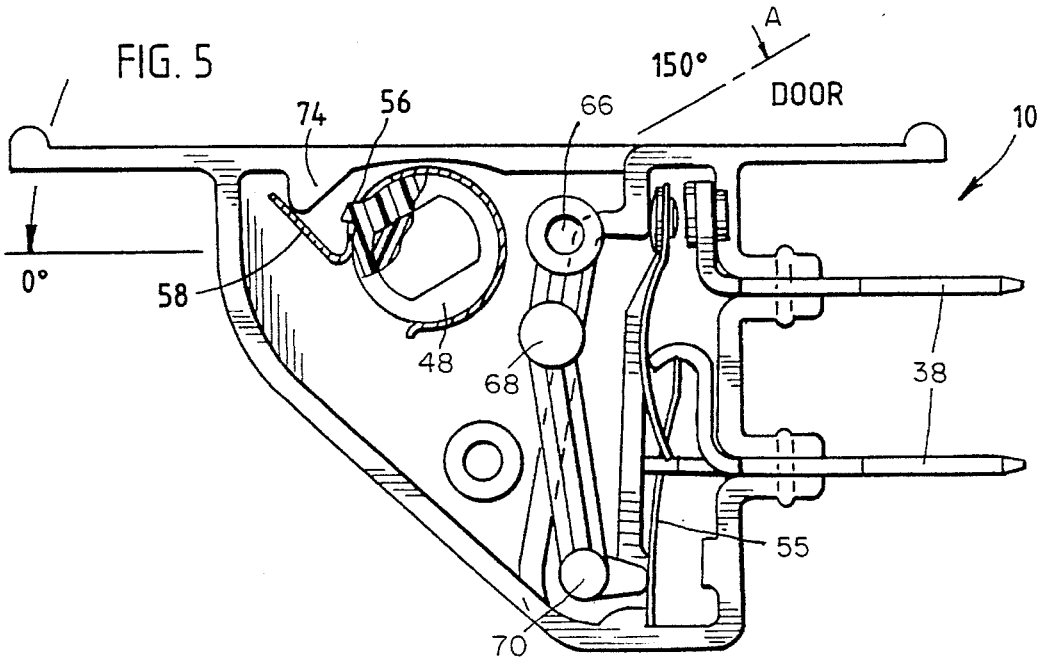
FIG. 6
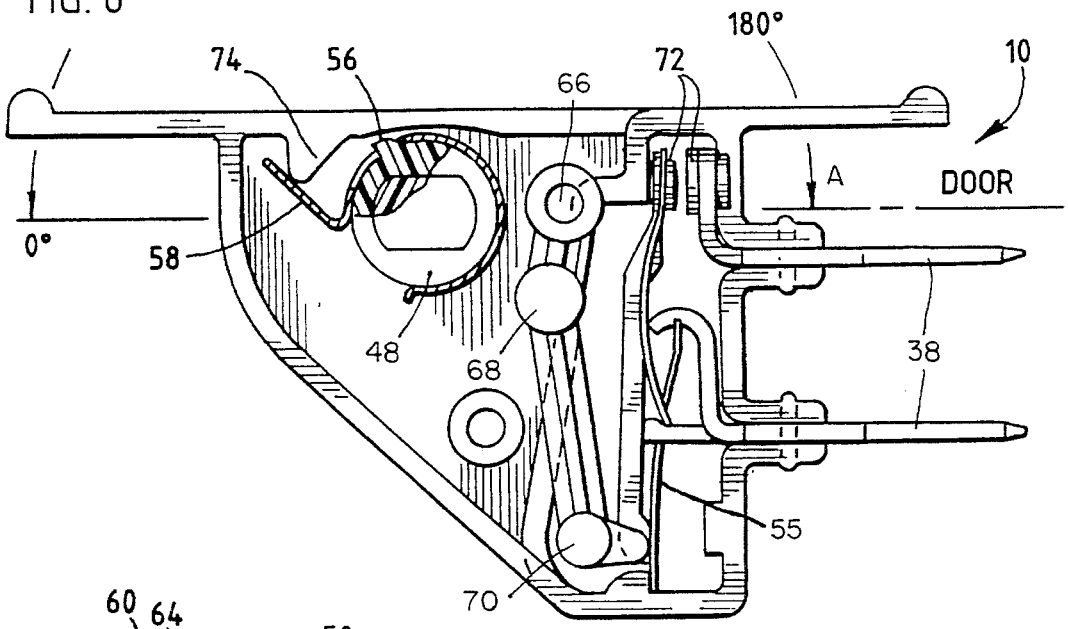
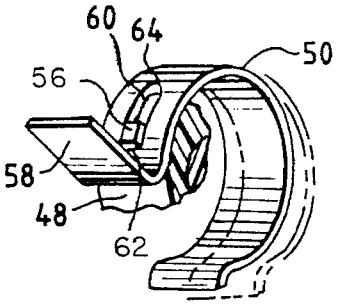
FIG. 7
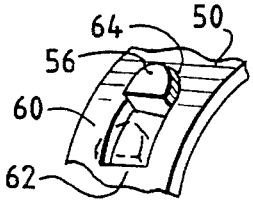
FIG. 8

HINGE OPERATED SWITCH ASSEMBLY

FIELD OF THE INVENTION

The present invention relates generally to switch assemblies, and more particularly to an electrical switch assembly, for use with an electrical appliance or the like, which is controlled by a shaft of a hinge connecting a door or similar member to the appliance and wherein electrical power to the appliance is cut off upon opening of the door so as to reduce the risk of injury to a user from the moving parts of the appliance.

BACKGROUND OF THE INVENTION

Electrical switches and assemblies for appliances such as washers, dryers or the like are typically provided for cooperation with a door of the appliance, such as the tub or drum door, to stop the appliance upon opening of the door. Existing switch assemblies typically are positioned beneath the top or outer surface of the appliance and are activated by an engagement arm connected to a distal corner of the door opposite the door hinge.

The engagement arm extends through an aperture in the top or outer surface of the appliance so as to make and break contact with the switch. An example of such a switch is disclosed in U.S. Pat. No. 2,513,804 which is typically designed to be operated by a very small amount of pressure.

Accordingly, during certain rather dangerous cycles of the appliance, such as a spin cycle of a washer, the appliance will only operate upon closing of the door. When the door is opened, the engagement arm on the door breaks the contact in the switch thereby stopping the appliance.

Such switches, however, are easily defeated by a user merely by inserting an article or even a finger through the aperture so as to make contact with the switch and operate the appliance with the door in the open position. Numerous injuries have resulted when such appliances are operated with the door in an open position since users tend to put their hands and arms inside the appliance to clear or balance an item, such as an article of clothing, during a spin cycle of a washer.

Additionally, due to the remote location of such switches with respect to the electrical control panel of the appliance, which is typically on the back of the appliance, additional wiring is required. Such additional wiring adds significant costs to the appliance both in the price of the additional wiring itself as well as the associated wiring harnesses, connectors and the labor required for installing such wiring within the appliance.

These types of switches are also typically exposed to harsh environments and extended use, especially when used in an appliance such as a washer or dryer or the like. Accordingly, these types of switches must be durable and substantially impervious to environmental conditions including exposure to high heat, water and harsh liquids such as detergents, bleach, fabric softeners, spot removers and other similar laundry aids.

It therefore would be desirable to provide an electrical switch assembly for activation by a door of an appliance to turn the appliance on and off which cannot be easily defeated by a user, significantly reduces the amount of wiring and labor involved in its installation and is durable enough to be utilized under harsh environmental conditions.

SUMMARY OF THE INVENTION

The invention provides a switch assembly, particularly a safety switch assembly, for activation by the shaft of a hinge of an article, such as an appliance or the like. The hinge can be utilized to secure a door, such as the door of a washing machine tub, or other member to the appliance wherein slight opening and closing of the door causes an electrical switch within the switch assembly to open and close a desired electrical circuit of the appliance so as to turn the appliance on and off and reduce the risk of injury.

The switch assembly is preferably mounted beneath the top surface of the appliance and cannot be readily accessed by a user in an attempt to defeat the switch. The switch assembly includes a cam member connected to the shaft of the hinge for rotation along with the shaft and an actuating band operably connected to the cam member for rotation along with the cam member and the hinge.

The actuating band includes an engagement portion for contact with a first portion of a lever for rotating the lever and causing a second end of the lever to make and break contact within an electrical switch of the switch assembly. The switch assembly includes structure for accommodating over-rotation of the door past the fully open position of the door without causing damage to the switch assembly or hinge.

The switch assembly is designed for use in environments which expose the switch assembly to a high degree of heat, moisture and substantially volatile liquids without causing damage to the switch assembly. Thus, a novel sealing insert is provided for operable communication between the cam member and the shaft of the hinge so as to prevent the elements from entering interior portions of the switch.

The design of the present switch assembly also provides for installation of the switch in close proximity to the electrical control panel, typically positioned at the rear of the appliance. Such a design substantially reduces the cost of materials, such as wiring and associated connectors and harnesses, as well as the labor involved in installing such materials. Labor costs can be excessive due to the close confines of the appliance and the need to protect the wiring against the harsh operating environment of the appliance.

BRIEF DESCRIPTION OF THE DRAWINGS

Numerous other features and advantages of the present invention will become readily apparent from the following description of the invention, when considered in connection with the accompanying drawings in which like reference characters designate like or corresponding parts throughout the several views, and wherein:

FIG. 5 is a cross-sectional view of the switch assembly of the invention illustrating the hinge shaft of the appliance door in a fully open position;

FIG. 6 is a cross-sectional view of the switch assembly of the invention illustrating the hinge shaft of the appliance door in an over-rotated position past the fully open position of FIG. 5;

FIG. 7 is a perspective view of the engagement band and a portion of the cam member of the switch assembly of the invention illustrating the typical seating of the cam within an aperture of the engagement band;

FIG. 8 is a perspective view of a portion of the engagement band and the cam member of the switch assembly of the invention illustrating the over-rotated position of the cam within the aperture of the engagement band;

DESCRIPTION OF THE PREFERRED EMBODIMENTS

While this invention is susceptible of embodiment in many different forms, the specification and the accompanying drawings disclose one or more forms as examples of the invention. The invention is not intended to be limited to the embodiments described, the scope of the invention being defined by in the appended claims.

For ease of description, the device of this invention is described in a typical operating position and terms such as upper, lower, horizontal, and the like, are utilized with reference to these positions. It will be understood, however, that the device of this invention may be manufactured, stored, transported and sold in an orientation other than the positions described.

Some of the figures illustrating the embodiments of the device of the present invention show conventional components, structural details and mechanical elements that will be recognized by one skilled in the art. The detailed descriptions of such elements, however, are not necessary to an understanding of the invention and, accordingly, are not presented herein.

Figure 1:
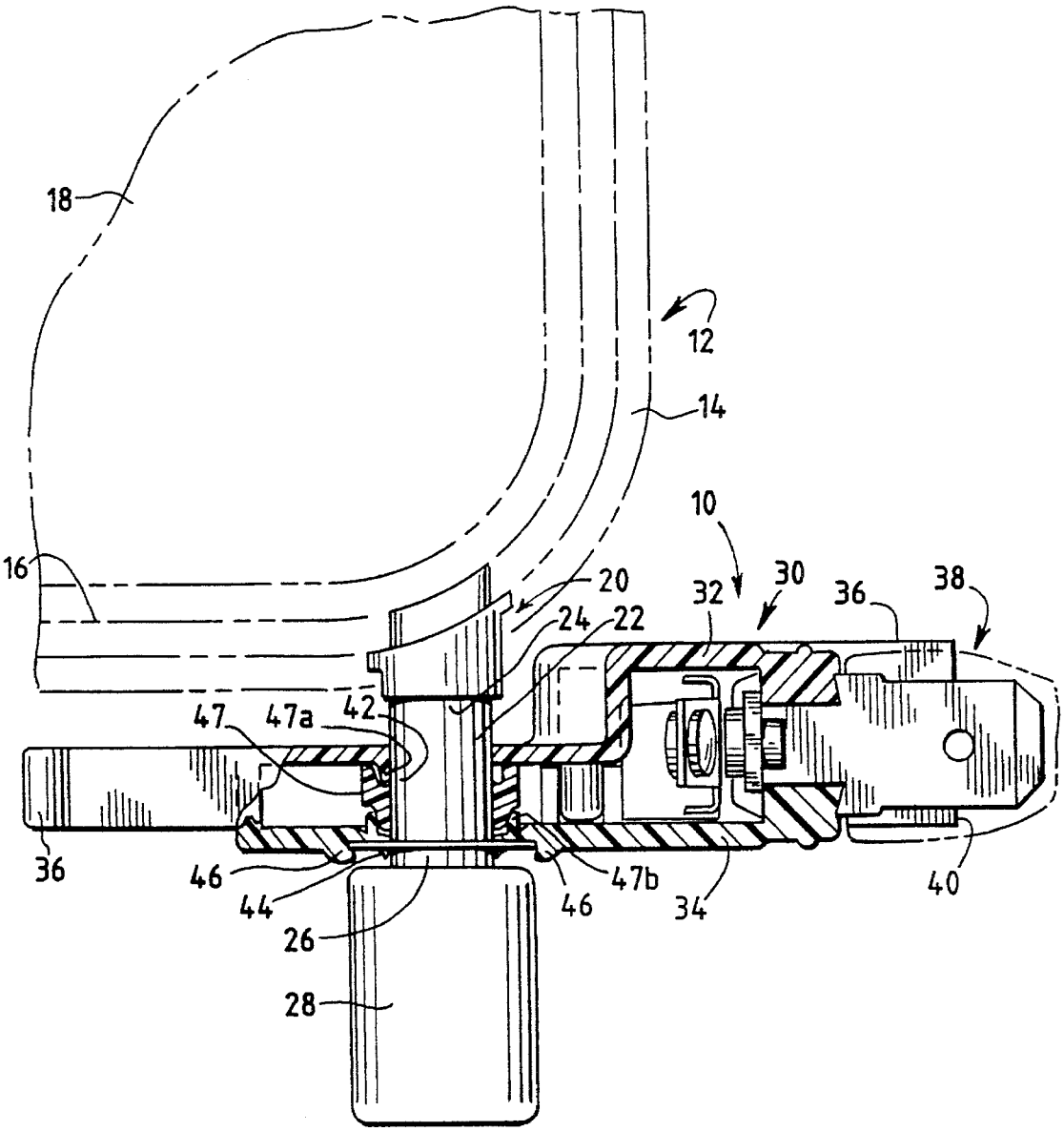
FIG. 1 is a top plan view, in partial section, of a switch assembly of the invention illustrated as secured to a shaft of a hinge of a door of an appliance, the door and appliance being illustrated in dotted outline.
Figure 2:
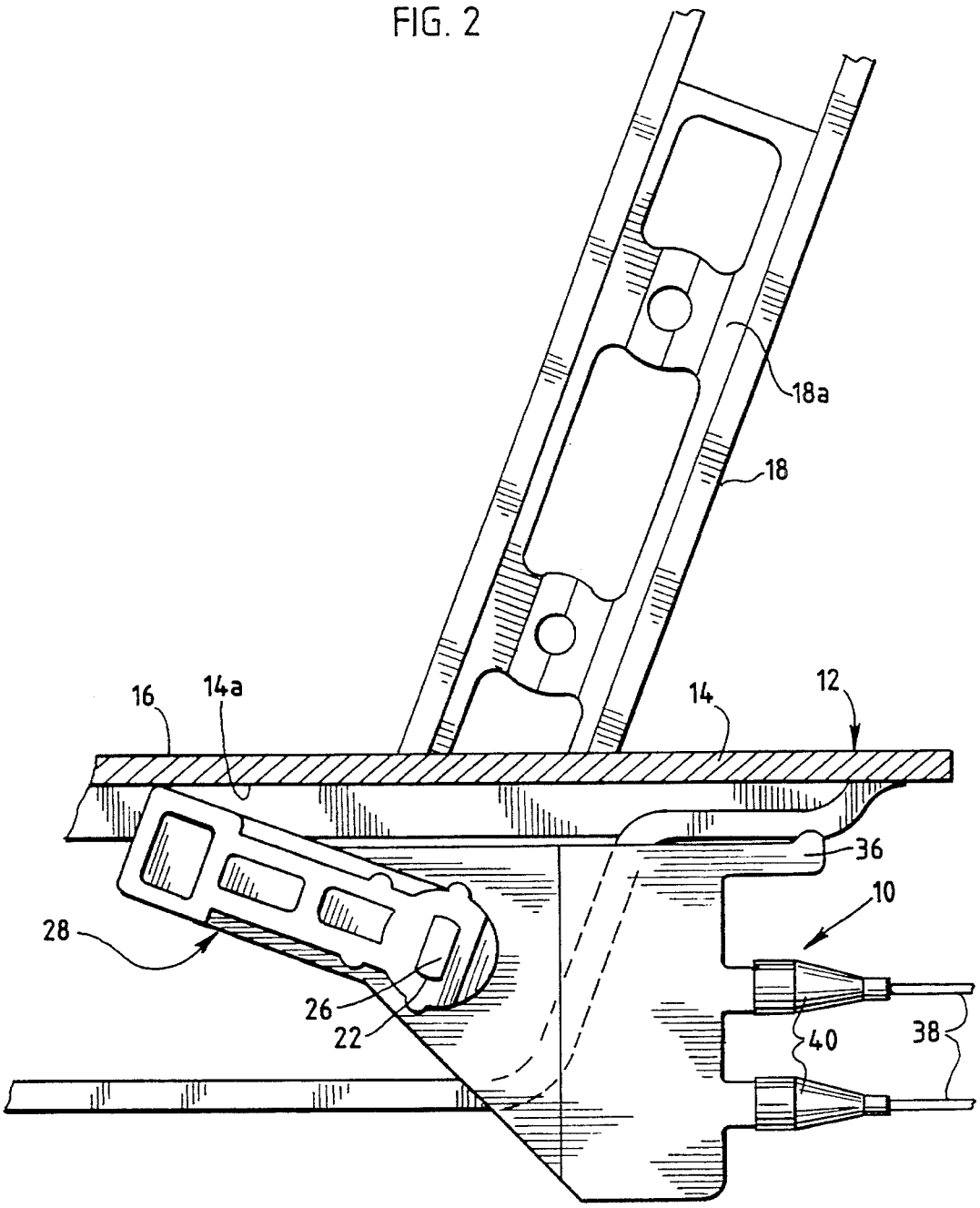
FIG. 2 is a side elevational view of the switch assembly of the invention secured to a hinge shaft of an appliance door and the frame of the appliance with the door in the fully open position.

Referring to FIGS. 1 and 2, the switch assembly of the invention is generally designated with the reference numeral 10. The assembly 10 is preferably utilized with an electrical appliance or other apparatus generally designated by the reference numeral 12.

The description of the assembly 10 of the present invention will be provided as it applies to an appliance 12 in the form of a top loading electric washing machine or washer. It is to be understood, however, that the assembly 10 can be utilized with a variety of apparatus without departing from the teachings of the present invention.

The washer 12 typically includes an outer or top surface or panel 14 having an opening 16 to its interior which is covered by a door 18 during use. The door 18 is attached to the top panel 14 by one or more hinges or hinge elements 20.

In a typical form of the washer 12, the door 18 is either hinged on its left or rear side as viewed from the front of the washer 12, but can vary. Additionally, a hinge 20 is provided on each opposite end of the hinged side of the door 18 rather than a hinge which spans the entire length of the hinged side of the door 18, such as a "piano" type hinge.

Each hinge 20 includes a hinge shaft or hinge pin 22 having a first proximal end 24 connected to a mounting insert 18a of the door 18 and a second distal end 26 having a door prop member 28 connected thereto. As FIG. 2 illustrates, when the door 18 is in the full-open position, the door prop member 28 contacts an underside 14a of the top surface 14 of the appliance 12 so as to initially restrict over-rotation of the door 18 past the full-open position.

The shaft 22 is preferably circular in cross-sectional configuration except for a portion of its distal end 26, which is flattened or rectangular in cross-sectional configuration. The rectangular portion extends through the switch assembly 10 for engagement therewith as described below.

To protect the switch assembly 10 from the harsh environment typically encountered within the appliance 12, the switch assembly 10 is preferably designed to be substantially waterproof. Accordingly, as FIG. 1 illustrates, the switch assembly 10 includes a housing 30 formed of a first case portion 32 and a second cover portion 34 which are preferably formed from plastic and are sealed together in a substantially waterproof manner, such as by ultrasonic welding or "double shear welding."

The second cover portion 34 includes integrally formed flanges 36 for engagement with the underside 14*a* of the top surface 14 of the appliance 12. The flanges 36 flex so as to accommodate manufacturing tolerances of the washer 12 and switch assembly 10. The flexing of the flanges 36 also provides a spring force to enable retention of the switch assembly 10 between the hinge shaft or pin 22 and the underside 14*a* of the top surface 14 and further enables the switch assembly 10 to "float" so as to accommodate any inaccuracies during hinge actuation.

To connect the switch assembly 10 within a desired electrical circuit (not illustrated), one or more electrical leads 38 extend from the first case portion 32 and are surrounded by a substantially waterproof cover or boot 40, formed from rubber or the like.

To enable the rectangular portion of the shaft 22 to extend through the switch assembly 10 for connection with the door prop 28, the housing 30 includes an aperture 42 extending completely therethrough. The aperture 42 preferably extends through both the first case portion 32 and the second cover portion 34, but can vary. It is to be noted, however, that the distal end 26 of the shaft 22 can terminate within the housing 30, if desired, and the door prop 28 can be eliminated thereby only requiring the aperture 42 to extend through the first case portion 32.

In order to retain the housing 30 in position on the shaft 22 and prevent the housing 30 from working loose, the second cover portion 34 includes a retaining ring 44 secured within holding arms 46 formed with the second cover portion 34. The retaining ring 44 provides the desired positioning of the housing 30 along the shaft 22 without inhibiting rotation of the shaft 22 with respect to the housing 30.

A substantially waterproof seal is provided between the shaft 22 and the housing 30 by means of an insert 47. The insert 47 enables rotation of the shaft 22 and is sealed against the shaft 22 by a press-fit provided by means of compression of the first case portion 32 and second cover portion 34 when assembled to form the housing 30. 10 The insert 47 thus seals against the shaft 22 in both directions, that is, toward the washer 12 and the door prop 28, to prevent water or other materials from entering the housing 30. The insert 47 is preferably made of TEFLON, but can vary and is press-fit between opposing lips 47*a* and 47*b* formed with the first case portion 32 and second cover portion 34, respectively.

Figure 3:
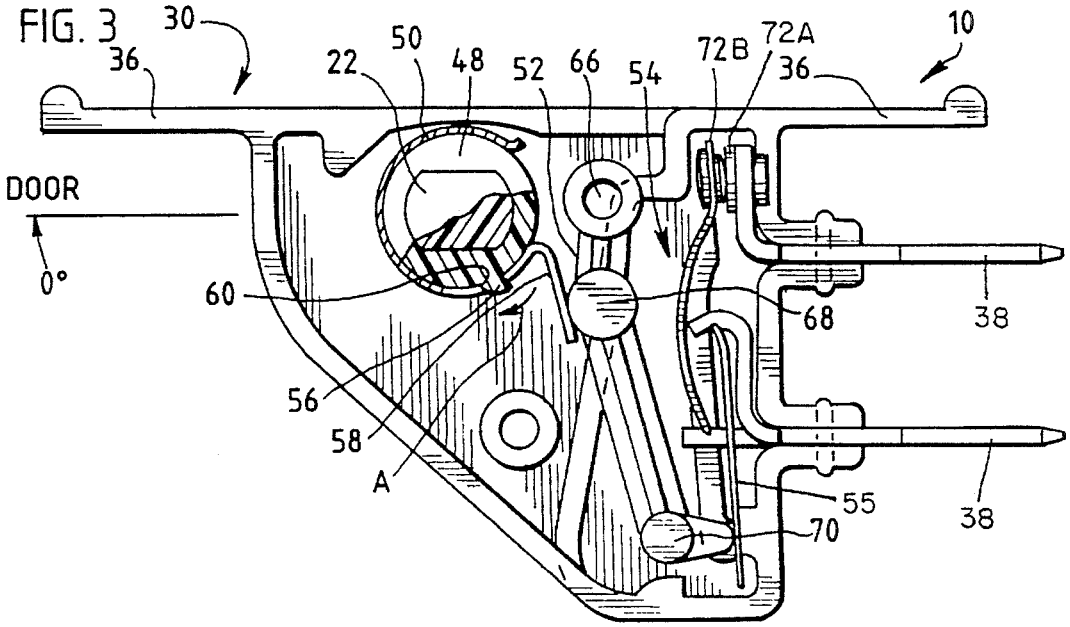
FIG. 3 is a cross-sectional view of a switch assembly of the invention illustrating the hinge shaft of the appliance door in a fully closed position.

As FIG. 3 illustrates, within the interior of the housing 30, the switch assembly 10 includes a cam member 48, an actuating band 50, a lever 52 and an electrical switch 54. The cam member 48 preferably has a circular cross-sectional configuration and is inserted about the rectangular portion of the shaft 22.

The cam member 48 includes a lug 56, which is tapered on one surface thereof, for operable cooperation with the actuating band 50 so as to provide the over-rotation feature as described below. The cam member 48 rotates counter-clockwise with the shaft 22 from a first position, illustrated in FIG. 3, where the door 18 is in its fully closed position to over-rotated positions of the door 18, as illustrated in FIGS. 5 and 6.

Preferably, the normal full-open position of the door 18 is between 110–120 degrees as FIG. 2 illustrates where the door prop 28 engages the underside 14*a* of the top surface of the washer 12. As described below, the switch assembly 10 provides for movement of the door 18 past the normal full-open position of FIG. 2 to the over-rotated 150 degree position of FIG. 5, or, in extreme cases, the 180 degree position of FIG. 6 where the door 18 actually contacts the top surface 14 of the washer 12.

The actuating band 50 is substantially in the shape of the letter "C" and includes an engagement arm 58 and an aperture 60 therethrough. The engagement arm 58 contacts the lever 52 and the aperture 60 accepts the lug 56 of the cam member 48.

The actuating band 50 is preferably formed of metal and is somewhat resilient so as to provide a spring type engagement about the cam member 48. Accordingly, during normal rotation of the shaft 22 and the cam member 48, the actuating band 50 maintains contact and rotates with the cam member 48.

As FIGS. 7 and 8 illustrate, the aperture 60 of the actuating band 50 is formed as a slot having a predetermined length and including a first flat end 62 and a second round end 64. Details of the cooperation between the aperture 60 and the lug 56 will be provided herein.

As FIG. 3 illustrates, the lever 52 is mounted for rotation within the first case portion 32 of the housing 30 about a pivot point 66 on one end thereof and includes a first intermediate portion 68 and a second end 70 opposite the pivot point 66. The first intermediate portion 68 is engaged by the engagement arm 58 of the actuating band 50 causing rotation of the lever 52 about the pivot point 66. The lever 52 is preferably designed with a 4:1 ratio with respect to the pivot point 66 and the second opposite end 70.

Figure 4:
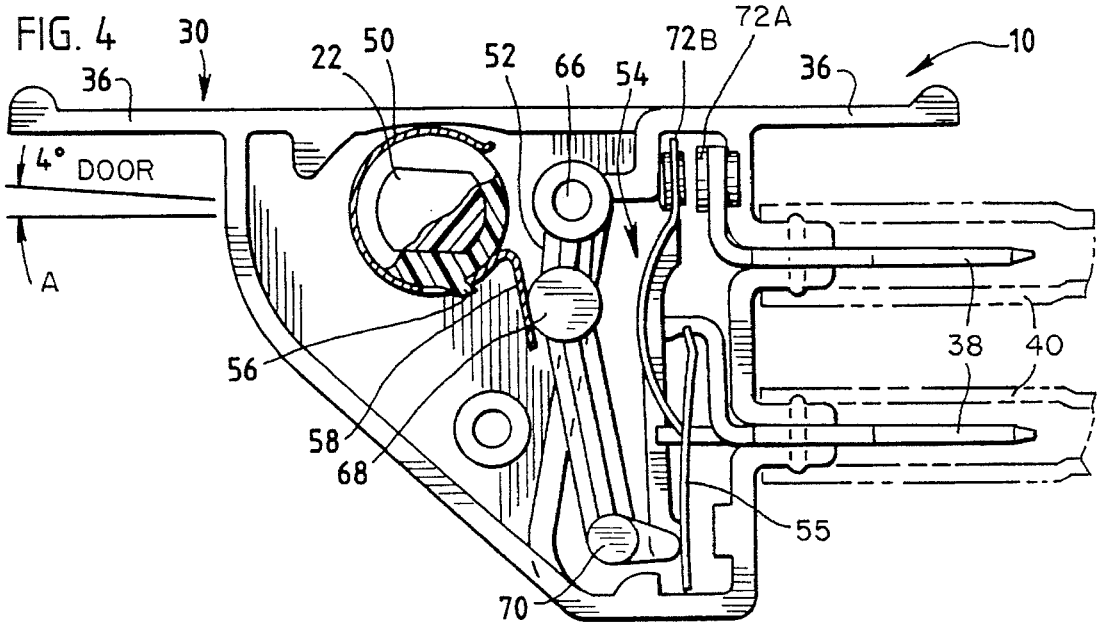
FIG. 4 is a cross-sectional view of the switch assembly of the invention illustrating the hinge shaft of the appliance door in a slightly open position which is sufficient to activate the electrical switch so as to turn off the appliance.

The electrical switch 54 is a conventional type of contact switch which is preferably spring loaded to remain in the open position when at rest as illustrated in FIGS. 4-6. Upon engagement with the second end 70 of the lever 52 when the door 18 is in the fully closed position as illustrated in FIG. 3, the electrical switch 54 is closed.

In operation, as FIG. 3 illustrates, when the door 18 is positioned in the first fully closed 10 position, the engagement arm 58 of the actuating band 50 forces the second end 70 of the lever 52 to the right. The second end 70 thus contacts an actuating member 55 of the electrical switch 54 which maintains contact between fixed contact 72A and movable contact 72B within the electrical switch 54 so as to enable the appliance 12 to operate.

Upon a slight opening of the door 18, as illustrated in FIG. 4, which is preferably approximately four degrees with respect to the horizontal, the engagement arm 58 of the actuating band 50 rotates slightly clockwise along with the shaft 22 and the cam member 48 in the direction of arrow "A". This enables the spring loaded electrical switch 54, including member 55, to rotate the lever 52 about its pivot point 66 and break contact between fixed and movable contacts 72A and 72B within the electrical switch 54 so as to stop the flow of electricity to the appliance 12.

Continued opening of the door 18 to the fully opened position illustrated in FIG. 2, which is approximately 110–120 degrees with respect to the horizontal, maintains the electrical switch 54 in the open position thereby preventing operation of the appliance 12. During such rotation in the direction of arrow "A", the spring engagement of the actuating band 50 enables the actuating band 50 to rotate along with the cam member 48 with the lug 56 in contact with the first flat end 62 of the aperture 60 of the actuating band 50.

FIGS. 5 and 6 illustrate the over-rotation feature of the switch assembly 10 where the door 18 is rotated past the full-open 110–120 degree position to approximately 150 and 180 degrees with respect to the horizontal. Opening of the lid past 150 degrees is abnormal and is caused by an extremely large load placed on the door 18, such as by a youngster hanging on the door 18. If not accounted for, the hinge 20 will suffer permanent damage.

With the switch assembly 10 of the present invention, however, over-rotation merely causes the lug 56 of the cam member 48 to rotate within the aperture 60 of the actuating band 50, which is held in position by engagement of the engagement arm 58 with a shoulder 74 of the housing 30, from the first flat end 62 to the second round end 64. Thus, the over-rotation position is accommodated by the switch assembly 10.

Upon closing of the door 18, the cam member 48 rotates with the shaft 22 back to the position illustrated in FIG. 3 such that the engagement arm 58 of the actuating band 50 can engage the lever 52 so as to close the contacts 72A and 72B of electrical switch 54 and thereby restore electricity to the appliance 12.

It is to be noted that the length of the aperture 60 and the relationship with the lug 56 can be adjusted so as to accommodate a variety of rotational positions of the door 18. Rotation of the door 18 past the 180 degree position can also be accommodated by the switch assembly 10.

For example, as FIG. 5 illustrates, when the door 18 is in the 180 degree position, the actuating band 50 is held in place by engagement of the engagement arm 58 and the shoulder 74. Further rotation of the door 18 in the direction of arrow "A" merely causes the tapered side of the lug 56 to slide out of the aperture 60 forcing the actuating band 50 away from the cam member 48. Upon closing of the door 18, the lug 56 reenters the aperture 60 for cooperation as described above.

Accordingly, the switch assembly 10 cuts off the power to the appliance 12 upon opening of the door 18 and, since it is positioned beneath the top panel 14 of the appliance 12, cannot be readily accessed by a user to restart the appliance 12. Additionally, the substantially waterproof design of the switch assembly 10 enables it to be utilized in the harsh environments encountered within many appliances, such as washers, dryers and similar articles.

The switch assembly 10 can be utilized to stop the power to other types of appliances and apparatus which may not be powered by electricity, but powered by another source of energy.

Figure 9:
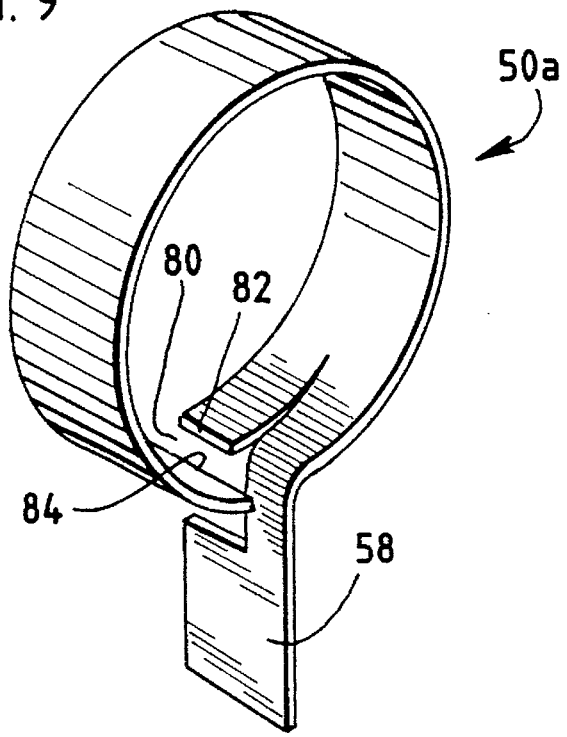
FIG. 9 is a perspective view of an alternate embodiment of the engagement band of the present invention.

FIG. 9 illustrates another embodiment of the actuating band 50a having an engagement arm 58. Instead of an aperture 60, the actuating band 50a is formed so as to have a slot 80 defined by opposing edges 82 and 84. The lug 56 of the cam member 48 is positioned within the slot 80 so that the actuating band 50*a* operates substantially the same as the actuating band 50.

Figure 10:
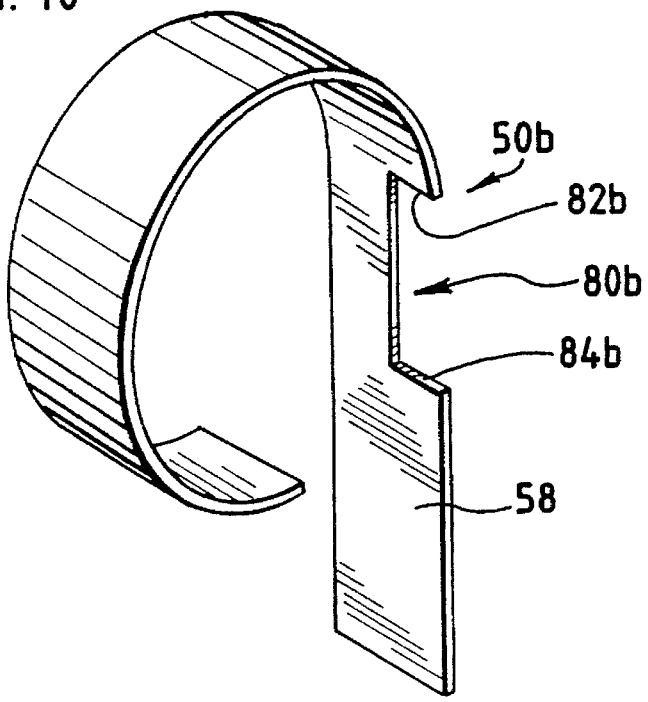
FIG. 10 is a perspective view of yet another embodiment of the engagement band of the present invention.

FIG. 10 illustrates yet another embodiment of the actuating band 50*b* having an engagement arm 58. The actuating band 50*b* likewise includes a slot 80*b* defined by opposing edges 82*b* and 84*b* and is positioned substantially in-line with the engagement arm 58. The actuating band 50*b* operates substantially the same as actuating bands 50 and 50*a*.

Modifications and variations of the present invention are possible in light of the above teachings. It is therefore to be understood that within the scope of the appended claims the invention may be practiced otherwise than as specifically described.

We claim:

1. A switch assembly for activation by a shaft of a hinge mechanism operatively connected to a first component, which is rotatable with respect to a second component, such that an electrical switch of an electrical circuit is controlled in response to rotatable movement of said first component and said shaft of said hinge mechanism with respect to said second component, comprising:

a cam member connected to said shaft of said hinge mechanism for rotation along with said shaft of said hinge mechanism;

an electrical switch for controlling an electrical circuit;

a lever having a first portion mounted within said switch assembly such that said lever is movable with respect to said electrical switch, and a second portion in operable communication with said electrical switch; and actuating means having a first portion operably connected to said cam member for rotation along with said cam member and said shaft of said hinge mechanism, and a second portion for engagement with a third portion of said lever such that upon rotation of said cam member and said shaft of said hinge mechanism between a first rotary position of said first component with respect to said second component and a second rotary position of said first component with respect to said second component, said second engagement portion of said actuating means will cause said lever to move to a first position at which said electrical switch is closed, and will permit said lever to move to a second position at which said electrical switch is opened.

2. The switch assembly as defined in claim 1 including means for accommodating over-rotation of said shaft of said hinge mechanism past a first fully open position of said hinge mechanism without causing damage to said switch assembly.

3. The switch assembly as defined in claim 1 including means for providing a substantially waterproof seal between said switch assembly and said shaft.

4. A switch assembly for activation by a shaft of a hinge mechanism operatively connected to a first component, which is rotatable with respect to a second component, such that an electrical switch of an electrical circuit is controlled in response to rotatable movement of said first component and said shaft of said hinge mechanism with respect to said second component, comprising:

a substantially waterproof housing having an aperture fined within at least one wall thereof for extension therethrough of said shaft of said hinge mechanism into said housing;

a cam member connected to said shaft of said hinge mechanism for rotation along with said shaft of said hinge mechanism;

an electrical switch disposed within said housing for controlling an electrical circuit;

a lever having a first portion rotatably mounted within said housing such that said lever is movable with respect to said electrical switch, and a second portion in operable communication with said electrical switch; and actuating means having a first portion operably connected to said cam member for rotation along with said cam member and said shaft of said hinge mechanism, and a second portion for engagement with a third portion of said lever such that upon rotation of said cam member and said shaft or said hinge mechanism between a first rotary position of said first component with respect to said second component and a second rotary position of said first component with respect to said second component, said second engagement portion of said actuating means will cause said lever to move to a first position at which said electrical switch is closed, and will permit said lever to move to a second position at which said electrical switch is opened.

5. The switch assembly as defined in claim 4 including means for accommodating over-rotation of said shaft of said hinge mechanism past a first fully open position of said hinge mechanism without causing damage to said switch assembly.

6. The switch assembly as defined in claim 4 including a substantially waterproof seal between said housing and said shaft.

7. The switch assembly as defined in claim 4 wherein said housing includes as least a first case portion, a second cover portion and means for providing a substantially waterproof seal between said shaft and said housing.

8. The switch assembly as defined in claim 4 wherein the hinge mechanism is secured between said first component which comprises a door and said second component which comprises an appliance and wherein further rotation of the door between a first fully open position and a second fully closed position causes said electrical switch to be closed, and rotation of the door through a predetermined angle between said second fully closed position and said first fully open position causes said electrical switch to be opened.

9. The switch assembly as defined in claim 8 wherein said predetermined angle is between 0–10 degrees.

10. The switch assembly as defined in claim 8 wherein said housing includes means for securing said housing with respect to said appliance for cooperation with the shaft of the hinge and for accommodating tolerances of said switch assembly and said appliance.

11. The switch assembly as set forth in claim 1, wherein:

said first component comprises a door hingedly connected to said second component which comprises an appliance.

12. The switch assembly as set forth in claim 1, wherein:

said first portion of said actuating means comprises a band member peripherally surrounding said cam member; and said second portion of said actuating means comprises an engagement arm integrally formed with said band member.

13. The switch assembly as set forth in claim 4, wherein:

said first portion of said actuating means comprises a band member peripherally surrounding said cam member; and said second portion of said actuating means comprises an engagement arm integrally formed with said band member.

14. The switch assembly as set forth in claim 1, wherein:

said cam member has a substantially rectangularly configured aperture defined therein; and a distal end portion of said shaft of said hinge mechanism has a substantially rectangular configuration for disposition within said substantially rectangularly configured aperture defined within said cam member such that said cam member is rotatably fixed upon and with respect to said distal end portion of said shaft of said hinge mechanism.

15. The switch assembly as set forth in claim 4, wherein:

said cam member has a substantially rectangularly configured aperture defined therein; and a distal end portion of said shaft of said hinge mechanism has a substantially rectangular configuration for disposition within said substantially rectangularly configured aperture defined within said cam member such that said cam member is rotatably fixed upon and with respect to said distal end portion of said shaft of said hinge mechanism.

16. The switch assembly as set forth in claim 12, wherein:

said band member has a substantially C-shaped configuration.

17. The switch assembly as set forth in claim 13, wherein:

said band member has a substantially C-shaped configuration.

18. The switch assembly as set forth in claim 12, wherein:

said band member is fabricated from a resilient metal strip.

19. The switch assembly as set forth in claim 13, wherein:

said band member is fabricated from a resilient metal strip.

20. The switch assembly as set forth in claim 9, wherein:

said predetermined angle is preferably approximately 4°.

* * * * *